US008627656B2

(12) United States Patent
Miyachi et al.

(10) Patent No.: US 8,627,656 B2
(45) Date of Patent: Jan. 14, 2014

(54) OIL SUPPLY DEVICE FOR VEHICLE

(75) Inventors: Eiji Miyachi, Nishio (JP); Hisashi Ono, Okazaki (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 810 days.

(21) Appl. No.: 12/870,422

(22) Filed: Aug. 27, 2010

(65) Prior Publication Data

US 2011/0067667 A1 Mar. 24, 2011

(30) Foreign Application Priority Data

Sep. 24, 2009 (JP) ..... 2009-219056
Jan. 29, 2010 (JP) ..... 2010-018321
Jul. 22, 2010 (JP) ..... 2010-164849

(51) Int. Cl.
*F16D 31/02* (2006.01)

(52) U.S. Cl.
USPC ..... 60/422; 60/456; 60/459; 123/196 R

(58) Field of Classification Search
USPC ..... 60/396, 422, 456, 459; 123/90.12, 123/90.13, 90.33, 196 R
See application file for complete search history.

(56) References Cited

U.S. PATENT DOCUMENTS 4,223,646 A 9/1980 Kinder
4,452,188 A 6/1984 Kosuda et al.
4,545,342 A 10/1985 Nakano et al.
4,800,850 A 1/1989 Yoshida et al.
5,666,915 A 9/1997 Kawashima et al.
2005/0061289 A1 3/2005 Plenzler et al.
2006/0260873 A1 11/2006 Suzuki et al.
2009/0311115 A1* 12/2009 Ono et al. ..... 123/196 R

FOREIGN PATENT DOCUMENTS

DE 196 25 296 A1 1/1997
DE 196 04 865 A1 8/1997
EP 0 275 713 A1 7/1988
EP 2 133 517 A1 12/2009
JP 6-212932 A 8/1994
JP 2002-303111 A 10/2002
JP 2004-116430 A 4/2004
JP 2004-143972 A 5/2004

(Continued)

OTHER PUBLICATIONS

European Search Report dated Dec. 27, 2010, issued by the European Patent Office in corresponding European Patent Application No. 10172454.

(Continued)

*Primary Examiner* — Michael Leslie
(74) *Attorney, Agent, or Firm* — Buchanan Ingersoll & Rooney PC

(57) ABSTRACT

An oil supply device for a vehicle includes an oil pump driven by a rotation of an internal combustion engine, a hydraulic actuator to which oil is supplied from the oil pump, an engine lubricating system to which the oil is supplied from the oil pump, an oil supply adjusting valve adjusting a supply condition of the oil from the oil pump to the hydraulic actuator and the engine lubricating system, a first oil supply passage supplying the oil from the oil pump to the hydraulic actuator, and a second oil supply passage supplying the oil from the oil pump to the engine lubricating system, wherein the oil supply adjusting valve consistently distributes the oil to the first oil supply passage and the second oil supply passage.

20 Claims, 14 Drawing Sheets

(56) References Cited

FOREIGN PATENT DOCUMENTS

| | | | |
|---|---|---|---|
| JP | 2008-019750 | A | 1/2008 |
| JP | 2008-291825 | A | 12/2008 |
| WO | WO 2010/013625 | A1 | 2/2010 |

OTHER PUBLICATIONS

Published Technical Information No. 2006-505946 (with English Translation) published on Nov. 9, 2006 (3 pages).

* cited by examiner

OIL SUPPLY DEVICE FOR VEHICLE

CROSS REFERENCE TO RELATED APPLICATIONS

This application is based on and claims priority under 35 U.S.C. §119 to Japanese Patent Application 2009-219056, filed on Sep. 24, 2009, Japanese Patent Application 2010-018321, filed on Jan. 29, 2010, and Japanese Patent Application 2010-164849, filed on Jul. 22, 2010, the entire contents of which are incorporated herein by reference.

TECHNICAL FIELD

This disclosure relates to an oil supply device for a vehicle.

BACKGROUND DISCUSSION

A known oil supply device for a vehicle, disclosed in JP2004-116430A (hereinafter referred to as Reference 1) includes a mechanical oil pump, an electric oil pump, a first relief valve, and a second relief valve. A discharge port of the mechanical oil pump and a suction port of the electric oil pump are connected in series with each other. The first relief valve opens when a pressure of the discharge port of the mechanical oil pump is higher than a first predetermined pressure. The second relief valve is arranged between a discharge port of the electric oil pump and an oil jet device (hydraulic actuator). The second relief valve opens when a pressure of the discharge port of the electric pump is higher than a second predetermined pressure. The discharge port of the mechanical oil pump connects to a lubricating route (engine lubricating system) that supplies a lubricating oil to portions of an internal combustion engine. In addition, the discharge port of the electrical oil pump connects to a variable valve timing device. The second predetermined pressure is set at a value larger than a value of the first predetermined pressure.

According to the oil supply device disclosed in Reference 1, the electric oil pump is arranged so as to be connected to the mechanical oil pump in series therewith while serving as a supplementary pump for the mechanical oil pump; therefore, an insufficient hydraulic pressure due to the mechanical oil pump may be compensated by the electric oil pump. However, the electric oil pump is applied to the oil supply device so as to serve only as the supplementary pump, therefore increasing a whole size of the oil supply device and leading to an increase of the weight and cost. Additionally, a more space to which the oil supply device is attached is required.

A need thus exists for an oil supply device, which is not susceptible to the drawback mentioned above.

SUMMARY

According to an aspect of this disclosure, an oil supply device for a vehicle includes an oil pump driven by a rotation of an internal combustion engine, a hydraulic actuator to which oil is supplied from the oil pump, an engine lubricating system to which the oil is supplied from the oil pump, an oil supply adjusting valve adjusting a supply condition of the oil from the oil pump to the hydraulic actuator and the engine lubricating system, a first oil supply passage supplying the oil from the oil pump to the hydraulic actuator, and a second oil supply passage supplying the oil from the oil pump to the engine lubricating system, wherein the oil supply adjusting valve consistently distributes the oil to the first oil supply passage and the second oil supply passage.

According to another aspect of the disclosure, an oil supply device for a vehicle includes a hydraulic actuator provided at an internal combustion engine and being operated by a hydraulic pressure, an engine lubricating system lubricating the internal combustion engine, an oil pump supplying oil to the hydraulic actuator and the engine lubricating system, and an oil supply adjusting valve arranged between the hydraulic actuator and the oil pump and between the engine lubricating system and the oil pump and distributing the oil, which is discharged from the oil pump, to the hydraulic actuator and the engine lubricating system, wherein the oil supply adjusting valve consistently distributes the oil to the hydraulic actuator and the engine lubricating system.

BRIEF DESCRIPTION OF THE DRAWINGS

The foregoing and additional features and characteristics of this disclosure will become more apparent from the following detailed description considered with the reference to the accompanying drawing, wherein.

DETAILED DESCRIPTION

An oil supply device 1 for a vehicle according to a first embodiment will be explained as follows with reference to illustrations of FIGS. 1 to 6.

Figure 1:
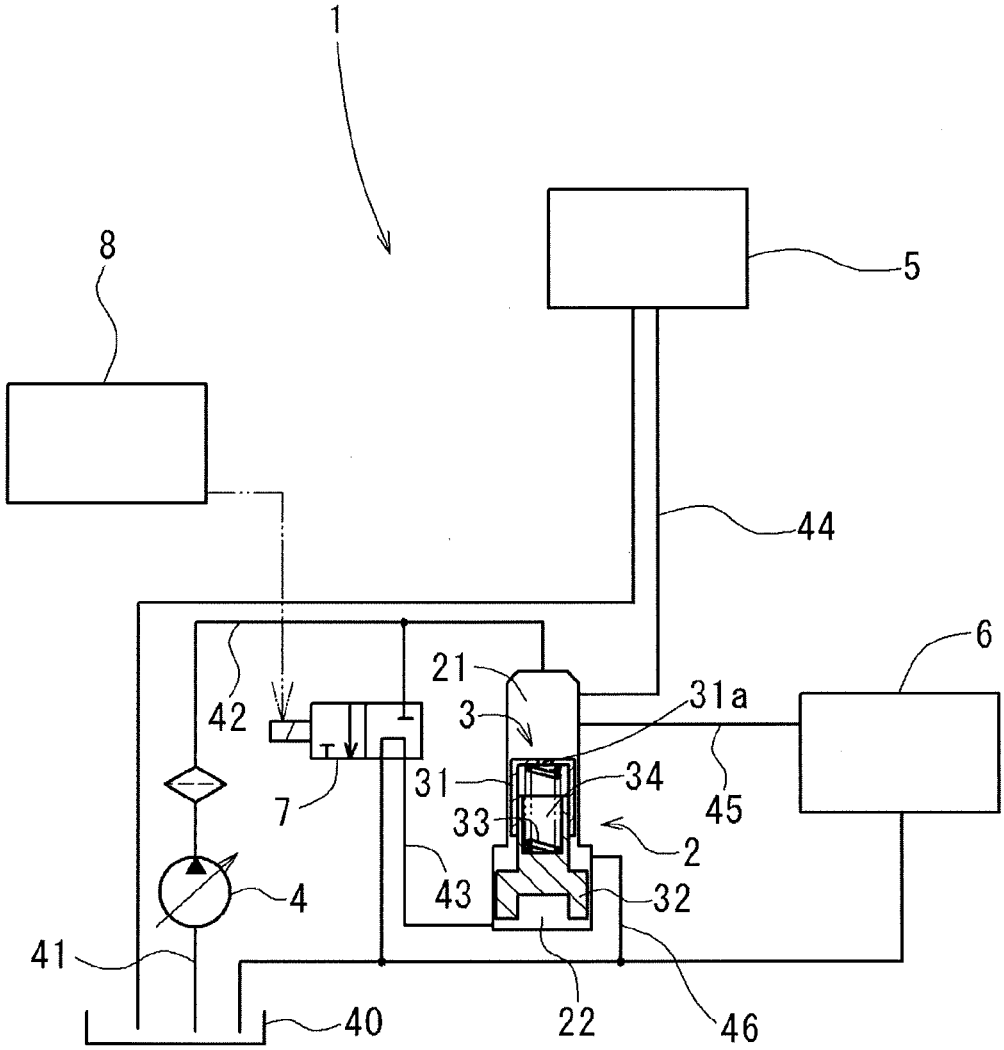
FIG. 1 is an oil passage routing chart of an oil supply device according to a first embodiment disclosed here.

FIG. 1 is an oil passage routing chart of the oil supply device 1 according to the first embodiment. The oil supply device 1 includes an oil pump 4 driven by an internal combustion engine, a hydraulic actuator 5 to which oil is supplied from the oil pump 4, an engine lubricating system 6 to which the oil is supplied from the oil pump 4, and an oil supply adjusting valve 2 adjusting a supply condition of the oil from the oil pump 4 to the hydraulic actuator 5 and the engine lubricating system 6. The hydraulic actuator 5 is provided at the internal combustion engine and while being operated by a hydraulic pressure. The engine lubricating system 6 lubricates the internal combustion engine. The oil supply adjusting valve 2 is arranged between the hydraulic actuator 5 and the oil pump 4 and between the engine lubricating system 6 and the oil pump 4 while distributing the oil, which is discharged from the oil pump 4, to the hydraulic actuator 5 and the engine lubricating system 6.

The oil supply adjusting valve 2 includes an oil flow control portion 21, a variable valve 3, and a first pressure chamber 22 (pressure portion). A first oil supply passage 44 and a second oil supply passage 45 are connected to the oil flow control portion 21. The oil is supplied from the oil pump 4 to the hydraulic actuator 5 via the first oil supply passage 44 and to the engine lubricating system 6 via the second oil supply passage 45. The variable valve 3 slides within the oil flow control portion 21 to thereby vary the supply condition of the oil to the hydraulic actuator 5 and the engine lubricating system 6. A hydraulic pressure from the first pressure chamber 22 allows the variable valve 3 to slide within the oil flow control portion 21. A second oil discharge passage 43 is connected to the first pressure chamber 22. The oil is supplied from an oil switching valve 7 via the second oil discharge passage 43 to the first pressure chamber 22.

The variable valve 3 includes a spool 31, a spring 33 (biasing member), and a retainer 32. The spool 31 receives a hydraulic pressure from the oil flow control portion 21. The spring 33 biases the spool 31 toward the oil flow control portion 21. The retainer 32 receives the hydraulic pressure from the first pressure chamber 22. The spring 31 is arranged between the spool 31 and the retainer 32. Further, the spool 31 includes a hole 31*a* through which the oil flows from the oil flow control portion 21. Furthermore, a second pressure chamber 34 is formed between the spool 31 and the retainer 32.

Moreover, a drain hole 46 is formed on an outer circumferential side of the retainer 32 and between the spool 31 and the retainer 32. The drain hole 46 connects to an oil pan 40. The drain hole 46 serves as a breathing hole when the spool 31 moves relative to the retainer 32.

An oil suction passage 41 is connected to the oil pump 4. The oil is suctioned by the oil pump 4 from the oil pan 40 via the oil suction passage 41. Then, the suctioned oil is discharged from the oil pump 4 via a first oil discharge passage 42 and is supplied to the oil supply adjusting valve 2 via the first oil discharge passage 42. Further, the first oil discharge passage 42 is diverged to connect to the oil switching valve 7 that supplies the oil from the oil pump 4 to the first pressure chamber 22.

A signal is outputted from an ECU 8 operating depending on hydraulic states of the hydraulic actuator 5 and the engine lubricating system 6. The signal outputted from the ECU 8 is transmitted to the oil switching valve 7. The ECU 8 determines whether or not the oil should be supplied from the oil switching valve 7 to the first pressure chamber 22 of the oil supply adjusting valve 2 via the second oil discharge passage 43.

Figure 2:
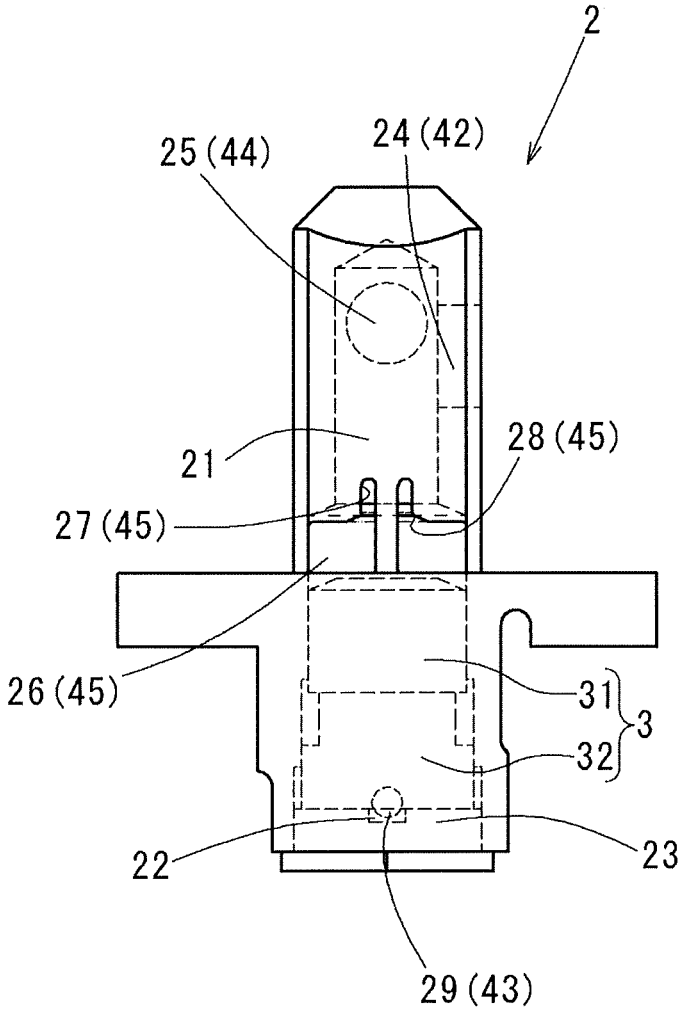
FIG. 2 is a front view of an oil supply adjusting valve of the oil supply device according to the first embodiment disclosed here.

FIG. 2 is a front view of the oil supply adjusting valve 2 of the oil supply device 1 according to the first embodiment. The oil supply adjusting valve 2 includes the oil flow control portion 21 having a first oil discharge passage portion 24, a first oil supply passage portion 25, and a second oil supply passage portion 26. The first oil discharge passage 42 communicating with the oil pump 4 is connected to the first oil discharge passage portion 24. The first oil supply passage 44 communicating with the hydraulic actuator 5 is connected to the first oil supply passage portion 25. The second oil supply passage 45 communicating with the engine lubricating system 6 is connected to the second oil passage portion 26. The oil flow control portion 21 includes a third oil supply passage portion 27 connecting to the second oil supply passage 45 in order to consistently distribute the oil from the oil pump 4 to the second oil supply passage 45. The oil flow control portion 21 further includes a connecting portion 28 connecting to the third oil supply passage portion 27 and configured to have an area of a flow passage decreasing from the second oil supply passage portion 26 to the third oil supply passage portion 27. A flow rate of the oil of the third oil supply passage portion 27, flowing to the second oil supply passage 45 is smaller than a flow rate of the oil of the second oil supply passage portion 26, flowing to the second oil supply passage 45. The flow rate of the oil of the third oil supply passage portion 27, flowing to the second oil supply passage 45, is sufficient to secure a minimum pressure required for the engine lubricating system 6.

Further, the second oil supply passage portion 26 is provided closer to the variable valve 3 than the first oil supply passage portion 25 so that the oil supplied from the first oil discharge passage 42 is preferentially supplied to the hydraulic actuator 5 via the first oil supply passage portion 25.

A plug 23 is fitted to the oil supply adjusting valve 2 with a screw to thereby arrange the variable valve 3 in the oil supply adjusting valve 2. The spool 31 has a first pressure receiving surface receiving the hydraulic pressure from the oil flow control portion 21. The retainer 32 has a first pressure receiving surface receiving the hydraulic pressure from the first pressure chamber 22. An area SA of the first pressure receiving portion of the spool 31 is smaller than an area of the first pressure receiving portion of the retainer 32.

The first pressure chamber 22 includes a second oil discharge passage portion 29 to which the second oil discharge passage 43 communicating with the oil switching valve 7 is connected.

Figure 3:
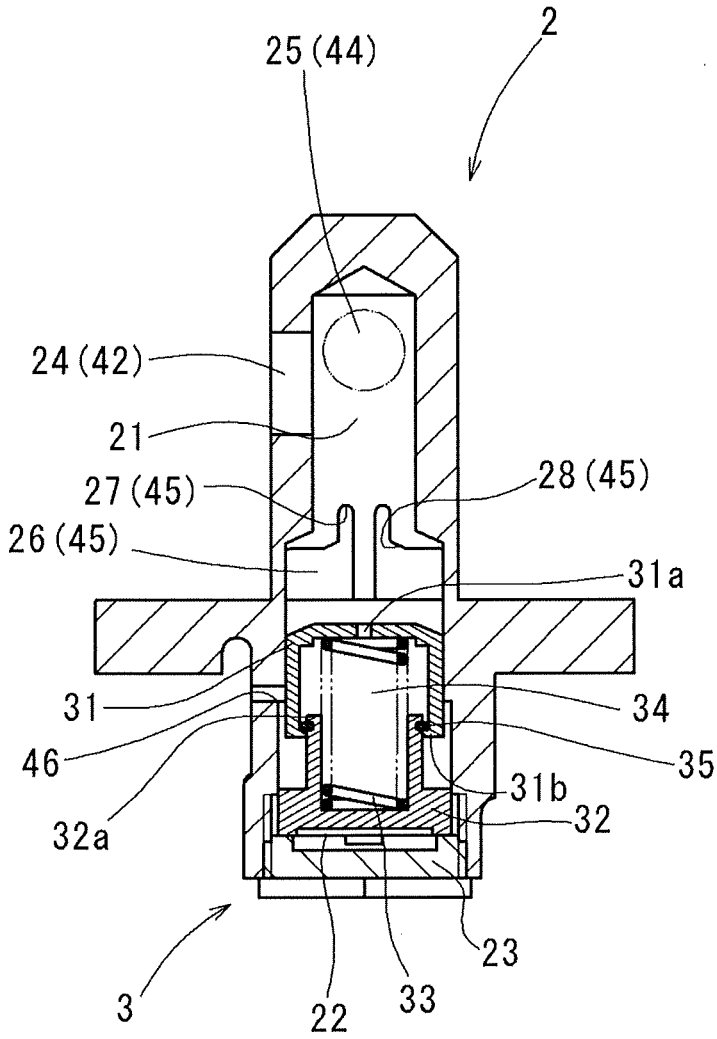
FIG. 3 is a cross-sectional rear view of the oil supply adjusting valve of the oil supply device according to the first embodiment when an oil switching valve connecting to the oil supply adjusting valve is not in operation.
Figure 5:
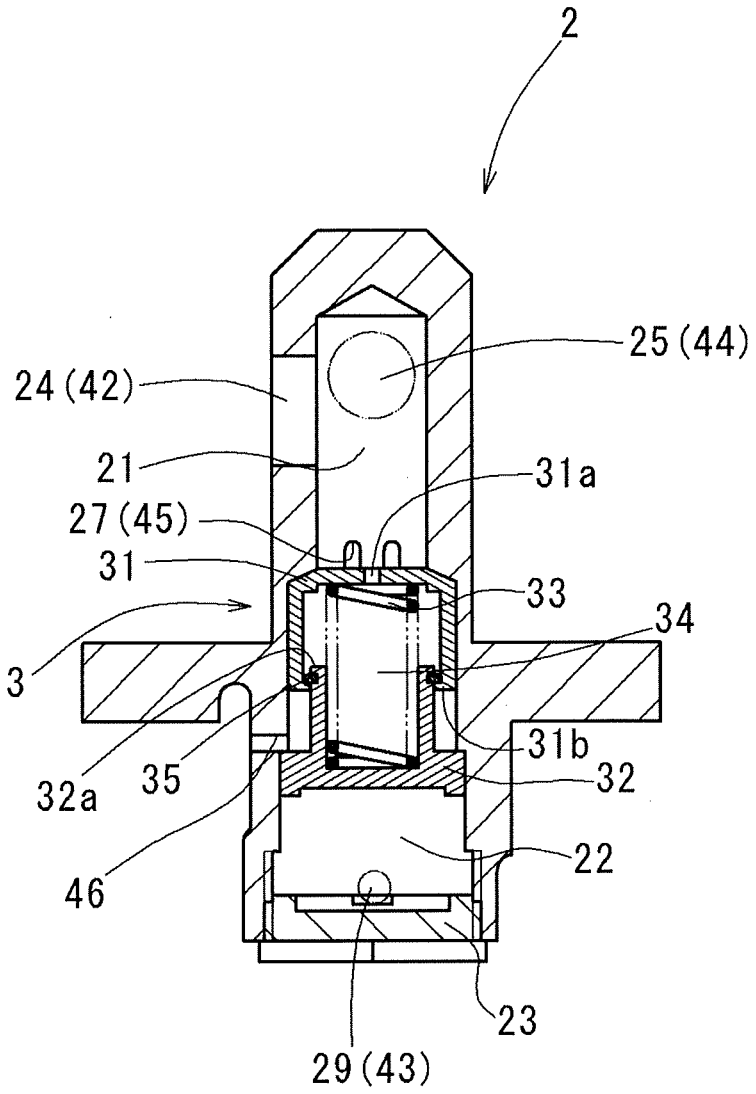
FIG. 5 is a cross sectional rear view of the oil supply adjusting valve of the oil supply device according to the first embodiment when the oil switching valve connecting to the oil supply adjusting valve is in operation and when a hydraulic pressure acting on the spool is low.
Figure 6:
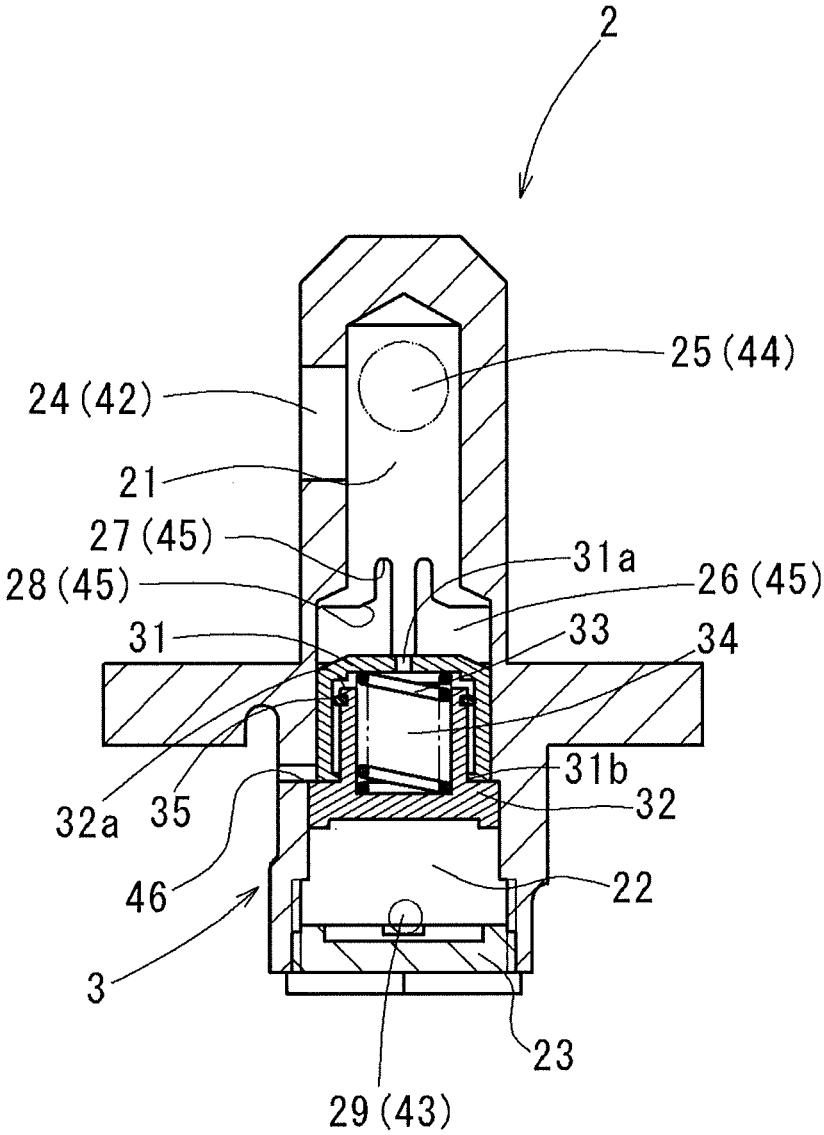
FIG. 6 is a cross-sectional rear view of the oil supply adjusting valve of the oil supply device according to the first embodiment when the oil switching valve connecting to the oil supply adjusting valve is in operation and when the hydraulic pressure acting on the spool is high.

FIG. 3 illustrates a cross-sectional rear view of the oil supply adjusting valve 2 of the oil supply device 1 according to the first embodiment when the oil switching valve 7 connecting to the oil supply adjusting valve 2 is not in operation. Further, each of FIG. 5 and FIG. 6 shows a cross-sectional rear view of the oil supply adjusting valve 2 when the oil switching valve 7 is in operation. When the oil switching valve 7 is in operation, the oil flows into the first pressure chamber 22 from the second oil discharge passage 43 via the second oil discharge passage portion 29 to slide the variable valve 3 (the spool 31 and the retainer 32) within the oil supply adjusting valve 2 toward the oil flow control portion 21. When the variable valve 3 slides toward the oil flow control portion 21, the oil consistently flows through an inner side of the oil supply adjusting valve 2 and through an inner side of the variable valve 3 to the second oil supply passage 45 and the engine lubricating system 6 via the third oil supply passage portion 27.

In the case where the spool 31 and the retainer 32 of the variable valve 3 are attached to each other, a C-shaped ring 35 is attached between the spool 31 and the retainer 32. Protruding portions 31*b* and 32*a* are provided at the spool 31 and the retainer 32, respectively, in order to prevent the C-shaped ring 35 from being detached from the spool 31 and the retainer 32 in the oil supply adjusting valve 2 when the C-shaped ring 35 is attached between the spool 31 and the retainer 32 so as to be positioned between the protruding portions 31*b* and 32*a*. Thus, the variable valve 3 is easily configured.

Figure 4A:
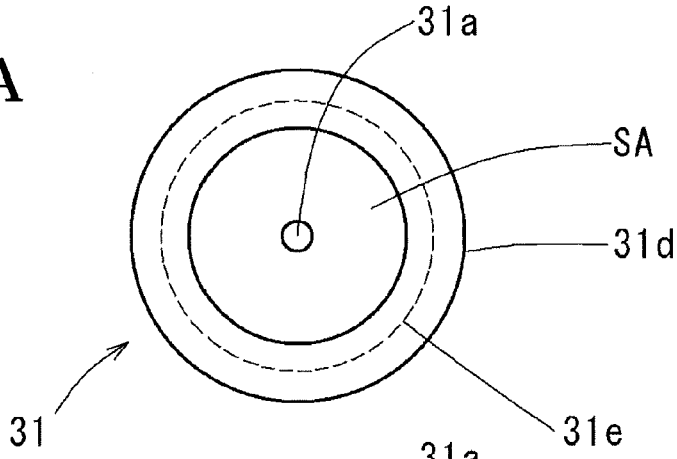
FIG. 4A is a top view illustrating a single spool.
Figure 4B:
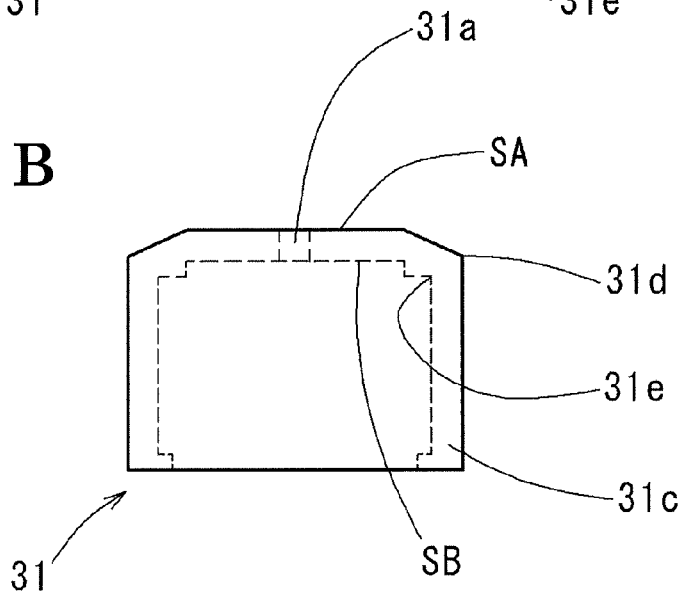
FIG. 4B is a front view of the spool.
Figure 4C:
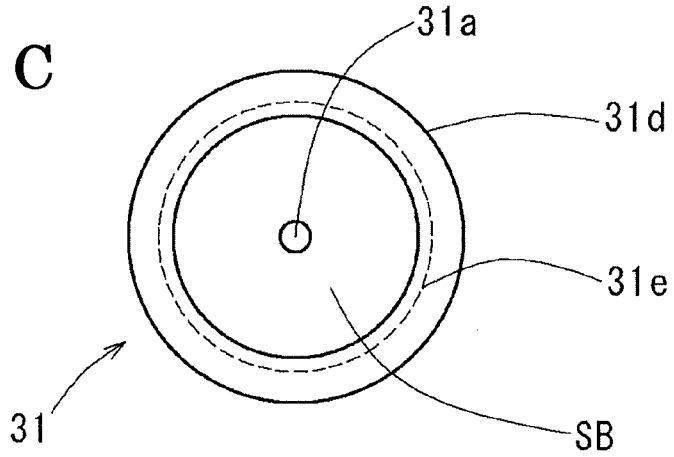
FIG. 4C is a bottom view of the spool.

FIG. 4A is a top view illustrating the single spool 31 of the oil supply device 1 according to the first embodiment, as seen from the oil flow control portion 21. FIG. 4B is a front view of the spool 31. FIG. 4C is a bottom view of the spool 31 seen from the second pressure chamber 34.

The spool 31 has the area SA of the first pressure receiving surface positioned to face the flow control portion 21 and an area SB of a second pressure receiving surface positioned to face the second pressure chamber 34 (the spring 33). When a hydraulic pressure acts on the spool 31, an area corresponding to a difference between the areas SA and SB (SA−SB) receives the hydraulic pressure. The area of the spool 31 corresponding to the difference between the areas SA and SB is a cross-sectional thickness of a side wall 31*c* of the spool 31, as seen from an axial direction of the spool 31. Here, the area SA of the first pressure receiving surface positioned to face the oil flow control portion 21 is an area that is obtained by subtracting an area of a circular shape of the hole 31*a* from an area of a circular shape defined by an outer surface 31*d* of the spool 31. The area SB of the second pressure receiving surface positioned to face the second pressure chamber 34 (the spring 33) is an area that is obtained by subtracting the area of the circular shape of the hole 31*a* from an area of a circular shape defined by an inner circumferential surface 31*e* of the spool 31. Likewise, a hydraulic pressure acting from the second pressure chamber 34 and the hydraulic pressure acting from the first pressure chamber 22 are offset. As a result, the offset hydraulic pressure is applied to a cross-sectional thickness of the retainer 32 as seen from an axial direction of the retainer 32. The cross-sectional thickness of the retainer 32 is an area corresponding to a difference between an area of the first pressure receiving surface of the retainer 32 and an area of a second pressure receiving surface of the retainer 32. The first pressure receiving surface of the retainer 32 is positioned to face the first pressure chamber 22 while the second pressure receiving surface of the retainer 32 is positioned to face the spring 33.

According to the first embodiment, the first pressure receiving surface of the retainer 32 is designed to be larger than the first pressure receiving surface of the spool 31 so that an appropriate length of the variable valve 3 may be obtained.

In addition, the variable valve 3 is inserted into the oil supply adjusting valve 2 and the plug 23 is attached to the variable valve 3. Accordingly, the variable valve 3 is accommodated within the oil supply adjusting valve 2. Thus, the variable valve 3 may be easily removed from the oil supply adjusting valve 2, therefore increasing efficiency in maintenance of the variable valve 3. Moreover, the first oil discharge passage portion 24 connected to the first oil discharge passage 42, the first oil supply passage portion 25 connected to the first oil supply passage 44, and the second oil supply passage portion 26 connected to the second oil supply passage 45 are all arranged at the oil supply adjusting valve 2, therefore reducing processing hours of the oil supply adjusting valve 2.

As described above, the variable valve 3 accommodated within the oil supply adjusting valve 2 includes the spool 31, the retainer 32 attached to the spool 31, and the spring 33 arranged between the spool 31 and the retainer 32. Further, the spool 31 includes the hole 31*a*. According to the configuration, the variable valve 3 varies the supply condition of the oil to the hydraulic actuator 5 and the engine lubricating system 6. For example, the variable valve 3 that does not include the spool 31 and the retainer 32 may vary the supply condition of the oil to the hydraulic actuator 5 and the engine lubricating system 6.

An operation of the oil supply device 1 according to the first embodiment will be explained as follows with reference to FIG. 3, FIG. 5, and FIG. 6.

The oil supply device 1 is configured so that the oil is suctioned by the oil pump 4 from the oil pan 40 via the oil suction passage 41 and thereafter is discharged to the first oil discharge passage 42. Then, the oil is supplied to the oil flow control portion 21 within the oil supply adjusting valve 2 via the first oil discharge passage portion 24 connected to the first oil discharge passage 42. Thereafter, the oil supplied to the oil supply adjusting valve 2 is supplied to the actuator 5 via the first oil supply passage portion 25 connected to the first oil supply passage 44, and to the engine lubricating system 6 via the second oil supply passage portion 26 connected to the second oil supply passage 45. At this time, the hydraulic pressure from the first pressure chamber 22 is not acting on the retainer 32; therefore, the spool 31 and the retainer 32 are positioned adjacent to the plug 23. Accordingly, the oil supplied from the oil pump 4 via the first oil discharge passage 42 to the oil flow control portion 21 is not limited by the spool 31 and the oil is discharged from the oil flow control portion 21 to the second oil supply passage 45 while an area of an opening of the second oil supply passage portion 26 is not reduced by the spool 31. In other words, the spool 31 illustrated in FIG. 3 does not function as a throttle valve.

Further, for example, when determining that hydraulic pressure states of the hydraulic actuator 5 and the engine lubricating system 6 need to be varied, the ECU 8 commands the oil switching valve 7 to operate. Then, the oil switching valve 7 driven into operation by the ECU 8 supplies the oil diverged from the first oil discharge passage 42, to the first pressure chamber 22 within the oil supply adjusting valve 2 via the second oil discharge passage portion 29 connected to the second oil discharge passage 43.

FIG. 5 is a cross-sectional view of the oil supply adjusting valve 2 when the oil is supplied to the first pressure chamber 22 to press the retainer 32 toward the first oil supply passage 44 to thereby shift the spool 31 and the retainer 32 toward the first oil supply passage 44. In FIG. 5, the area of the opening of the second oil supply passage portion 26 is reduced by the spool 31 and the supply of the oil from the oil pump 4 via the first oil discharge passage 42 to the oil flow control portion 21 is limited by the spool 31. A limited volume of the oil is discharged to the second oil supply passage 45 accordingly. In other words, the spool 31 shown in FIG. 5 functions as the throttle valve.

In addition, the oil discharged from the oil pump 4 via the first oil discharge passage 42 and supplied to the oil flow control portion 21 is discharged to the first oil supply passage 44 regardless of the movement of the spool 31 and the retainer 32. That is, in FIG. 5, a volume of the oil to be supplied to the second oil supply passage 45 is reduced by the spool 31 while a volume of the oil to be supplied to the first oil supply passage 44 is larger than the volume of the oil supplied to the second oil supply passage 45. In other words, the oil discharged from the oil pump 4 via the first oil discharge passage 42 and supplied to the oil flow control portion 21 is preferentially supplied to the first oil supply oil passage 44 rather than to the second oil supply passage 45.

When a rotating speed of the oil pump 4 increases in a condition shown in FIG. 5, a hydraulic pressure of the oil discharged from the oil pump 4 via the first oil discharge passage 42 to the oil flow control portion 21 increases and the increased hydraulic pressure acts on the spool 31; therefore, the spool 31 is moved toward the plug 23 by the increased hydraulic pressure in the opposite direction from a direction in which a biasing force of the spring 33 is acting. As a result, the condition shown in FIG. 5 shifts to a condition illustrated in FIG. 6. The spool 31 reducing the area of the opening of the second oil supply passage portion 26 in FIG. 5 is moved relative to the retainer 32 toward the plug 23 in the condition shown in FIG. 6, therefore increasing the area of the opening of the second oil supply passage portion 26 and releasing the limited supply of the oil to the second oil supply passage 45. In other words, when the condition shown in FIG. 5 shifts to the condition shown in FIG. 6, the volume of the oil to be supplied to the engine lubricating system 6 is gradually increased.

Figure 7:
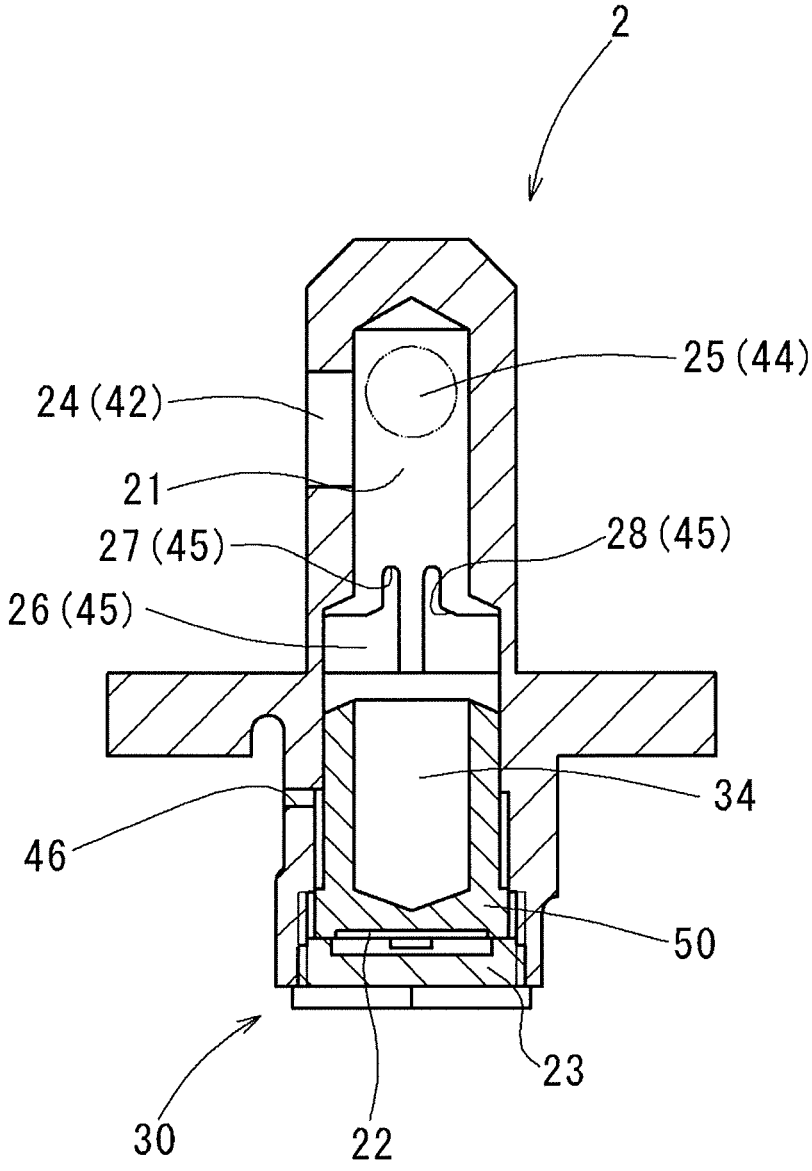
FIG. 7 is a cross-sectional rear view of the oil supply adjusting valve of the oil supply device according to a second embodiment when the oil switching valve connecting to the oil supply adjusting valve is not in operation.

A second embodiment of the oil supply device 1 will be explained as follows with reference to FIG. 7 and FIG. 8.

The oil supply device 1 according to the second embodiment is different from the oil supply device 1 according to the first embodiment in that the spool 31, the retainer 32, and the spring 33 are modified. Other configurations of the second embodiment are the same as those of the first embodiment; therefore, explanations of the same configurations will be omitted.

A spool 50 is applied to the oil supply device 1 according to the second embodiment instead of the spool 31, the retainer 32, and the spring 33 described in the first embodiment. In particular, a variable valve 30 is formed by the spool 50 only. The spool 50 is formed in a cylindrical hollow shape having a bottom portion. Further, the spool 50 has similar functions of the spool 31 and the retainer 32 described in the first embodiment while not having the hole 31*a* described in the first embodiment.

In addition, the spool 50 according to the second embodiment may be formed in a column shape instead of the cylindrical hollow shape having the bottom portion. The cylindrical hollow-shaped spool 50 having the bottom portion does not require a material applied to a solid-core portion of the column-shaped spool 50, therefore being downsized in weight, compared to the column-shaped spool 50.

An operation of the oil supply device 1 according to the second embodiment will be described below. The oil supply device 1 is configured so that the oil is suctioned by the oil pump 4 from the oil pan 40 via the oil suction passage 41 and thereafter is discharged to the first oil discharge passage 42. Then, the oil is supplied to the oil flow control portion 21 within the oil supply adjusting valve 2 via the first oil discharge passage portion 24 connected to the first oil discharge passage 42. Thereafter, the oil supplied to the oil supply adjusting valve 2 is supplied to the actuator 5 via the first oil supply passage portion 25 connected to the first oil supply passage 44 and to the engine lubricating system 6 via the second oil supply passage portion 26 connected to the second oil supply passage 45. At this time, the hydraulic pressure from the first pressure chamber 22 is not acting on the spool 50; therefore, the spool 50 is positioned adjacent to the plug 23. Accordingly, the supply of the oil from the oil pump 4 via the first oil discharge passage 42 to the oil flow control portion 21 is not limited and the oil is discharged to the second oil supply passage 45 while the area of the opening of the second oil supply passage portion 26 is not reduced by the spool 50. In other words, the spool 50 illustrated in FIG. 7 does not function as a throttle valve.

Further, for example, when determining that the hydraulic pressure states in the hydraulic actuator 5 and the engine lubricating system 6 need to be varied, the ECU 8 commands the oil switching valve 7 to operate. Then, the oil switching valve 7 driven into operation by the ECU 8 supplies the oil diverged from the first oil discharge passage 42, to the first pressure chamber 22 within the oil supply adjusting valve 2 via the second oil discharge passage portion 29 connected to the second oil discharge passage 43.

Figure 8:
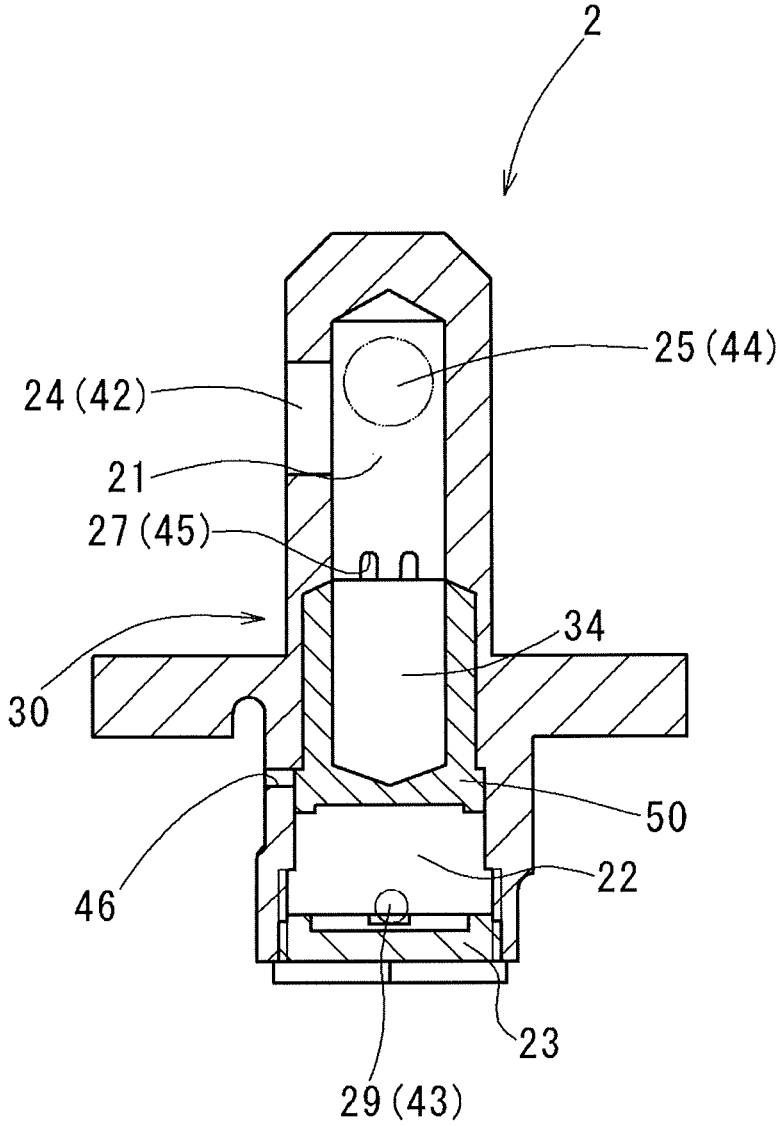
FIG. 8 is a cross-sectional rear view of the oil supply adjusting valve of the oil supply device according to the second embodiment when the oil switching valve connecting to the oil supply adjusting valve is in operation.

FIG. 8 is a cross-sectional view of the oil supply adjusting valve 2 when the oil is supplied to the first pressure chamber 22 to press the spool 50 toward the first oil supply passage 44 to thereby shift the spool 50 toward the first oil supply passage 44. In FIG. 8, an area of an opening of the second oil supply passage 45 is reduced by the spool 50. Further, the supply of the oil from the oil pump 4 via the first oil discharge passage 42 to the oil flow control portion 21 is limited by the spool 50 and a limited volume of the oil is discharged to the second oil supply passage 45. In other words, the spool 50 shown in FIG. 8 functions as the throttle valve.

In addition, the oil discharged from the oil pump 4 via the first oil discharge passage 42 and supplied to the oil flow control portion 21 is discharged to the first oil supply passage 44 regardless of the movement of the spool 50. That is, in FIG. 8, the volume of the oil to be supplied to the second oil supply passage 45 is reduced by the spool 50 while the volume of the oil to be supplied to the first oil supply passage 44 is larger than the volume of the oil supplied to the second oil supply passage 45. In other words, the oil discharged from the oil pump 4 via the first oil discharge passage 42 and supplied to the oil flow control portion 21 is preferentially supplied to the first oil supply oil passage 44 rather than to the second oil supply passage 45.

When the rotating speed of the oil pump 4 increases in a condition shown in FIG. 8 and the ECU 8 determines that the increased hydraulic pressure acts on the hydraulic actuator 5, the ECU 8 stops the operation of the oil switching valve 7. Accordingly, the spool 50 is moved toward the plug 23 to shift the condition shown in FIG. 8 to a condition shown in FIG. 7, therefore not functioning as the throttle valve. Thus, the operation of the oil switching valve 7 is stopped by the ECU 8; therefore, the engine lubricating system 6 may secure a required hydraulic pressure when the internal combustion engine operates at high speed.

A third embodiment of the oil supply device 1 will be described as follows with reference to FIG. 9 as well as FIG. 3, FIG. 5, and FIG. 6 that are applied in the explanation of the first embodiment.

The oil supply device 1 according to the third embodiment is different from the first embodiment in that the oil switching valve 7 and the ECU 8 that controls the oil switching valve 7 are excluded. Other configurations of the third embodiment are the same as those of the first embodiment; therefore, explanations of the same configurations will be omitted.

The variable valve 3 according to the third embodiment includes the spool 31 and the retainer 32 positioned in the vicinity of the first pressure chamber 22 by gravity. After the oil pump 4 is operated to discharge the oil to the first oil discharge passage 42, a hydraulic pressure is applied to the first pressure chamber 22 by the oil supplied to the first pressure chamber 22 via the second oil discharge passage 43. Further, simultaneously, a hydraulic pressure is applied to the oil flow control portion 21 by the oil flowing through the first oil discharge passage 42 to the oil flow control portion 21. The hydraulic pressure acting on the oil flow control portion 21 has approximately the same magnitude as the hydraulic pressure acting on the first pressure chamber 22. Furthermore, the first pressure receiving surface of the retainer 32 on which the hydraulic pressure in the first pressure chamber 22 acts is larger than the first pressure receiving surface of the spool 31 on which the hydraulic pressure in the oil flow control portion 21 acts. As a result, when the hydraulic pressure of the oil acts on the oil flow control portion 21 and the first pressure chamber 22, the spool 31 and the retainer 32 are moved in a direction that is opposite from a direction in which gravity is acting.

An operation of the oil supply device 1 according to the third embodiment will be explained as follows. When the internal combustion engine is not driven, the oil pump 4 is also not in operation. Accordingly, the spool 31 and the retainer 32 are positioned adjacent to the first pressure chamber 22 by gravity as describe above and are located in the same position as in FIG. 3.

When the internal combustion engine is driven, the oil pump 4 is also driven into operation. Then, the oil is suctioned by the oil pump 4 from the oil pan 40 via the oil suction passage 41. Thereafter, the oil is discharged to the first oil discharge passage 42 and supplied to the oil flow control portion 21. Then, the oil supplied to the oil supply adjusting valve 2 is supplied to the actuator 5 via the first oil supply passage portion 25 connected to the first oil supply passage 44 and to the engine lubricating system 6 via the second oil supply passage portion 26 connected to the second oil supply passage 45. At this time, the area of the opening of the second oil supply passage 45 is reduced by the spool 31 as shown in FIG. 5. Further, the supply of the oil from the first oil discharge passage 42 to the oil flow control portion 21 is limited by the spool 31 and the limited volume of the oil is discharged to the second oil supply passage 45. In other words, the spool 31 functions as the throttle valve as shown in FIG. 5.

In addition, the oil discharged from the oil pump 4 via the first oil discharge passage 42 and supplied to the oil flow control portion 21 is discharged to the first oil supply passage 44 regardless of the movement of the spool 50. That is, the volume of the oil to be supplied to the second oil supply passage 45 is reduced by the spool 50 while the volume of the oil to be supplied to the first oil supply passage 44 is larger than the volume of the oil supplied to the second oil supply passage 45. In other words, the oil discharged from the oil pump 4 via the first oil discharge passage 42 and supplied to the oil flow control portion 21 is preferentially supplied to the first oil supply oil passage 44 rather than to the second oil supply passage 45.

Figure 9:
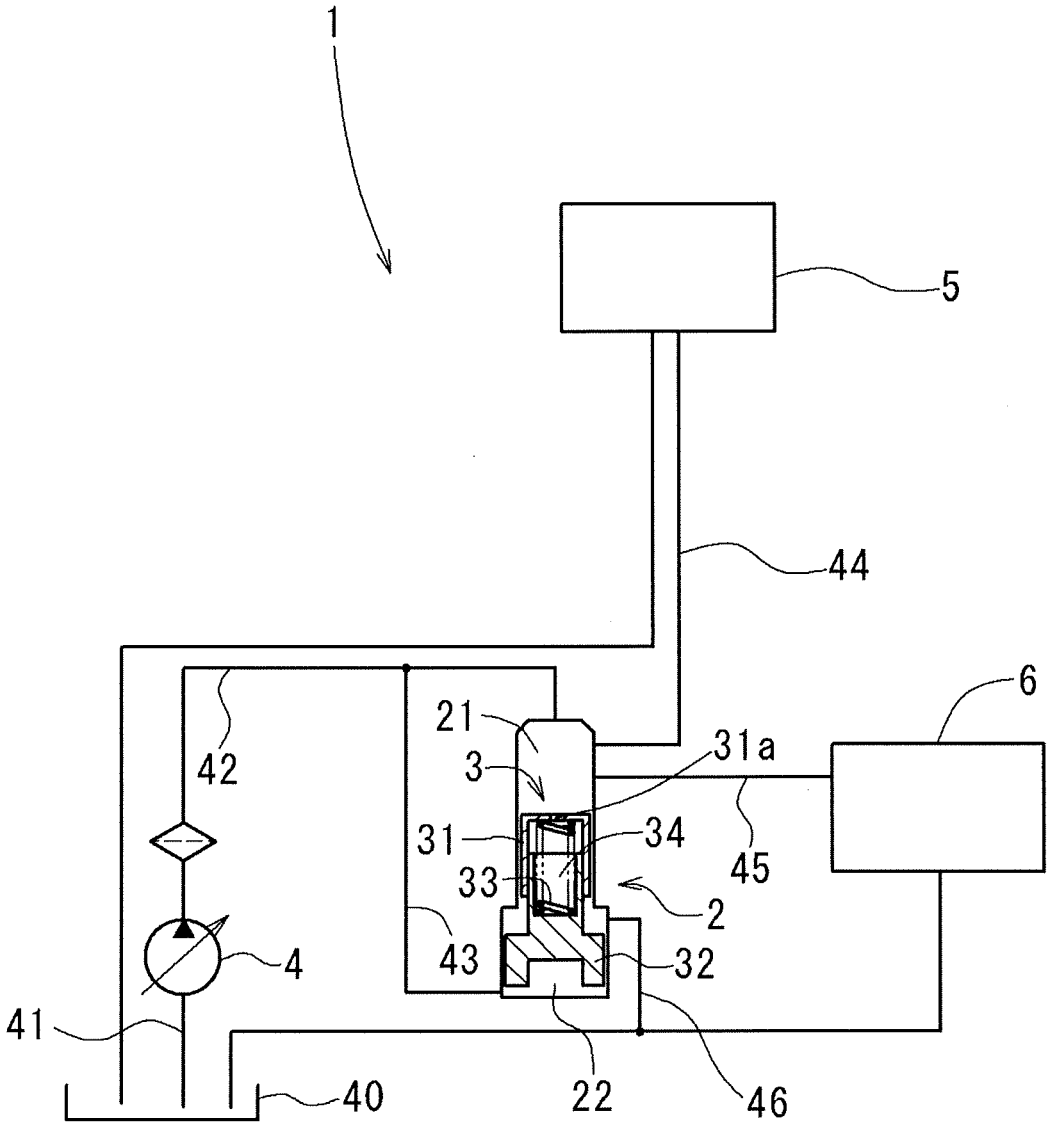
FIG. 9 is an oil passage routing chart of the oil supply device according to a third embodiment disclosed here.

When the rotating speed of the oil pump 4 increases in the condition shown in FIG. 5 and in a condition shown in FIG. 9, a hydraulic pressure of the oil to be supplied from the oil pump 4 to the first oil discharge passage 42 increases and the increased hydraulic pressure acts on the spool 31. Accordingly, the spool 31 is moved toward the plug 23 by the increased hydraulic pressure in the opposite direction from the acting direction of the biasing force of the spring 33 to therefore shift the condition shown in FIG. 5 to the condition shown in FIG. 6. The spool 31 reducing the area of the opening of the second oil supply passage 45 in FIG. 5 is moved relative to the retainer 32 toward the plug 23 in the condition shown in FIG. 6, therefore increasing the area of the opening of the second oil supply passage 45 and releasing the limited discharge of the oil to the second oil supply passage 45. In other words, when the conditions of FIG. 5 and FIG. 9 shift to the condition shown in FIG. 6, the volume of the oil to be supplied to the engine lubricating system 6 is gradually increased.

Figure 10:
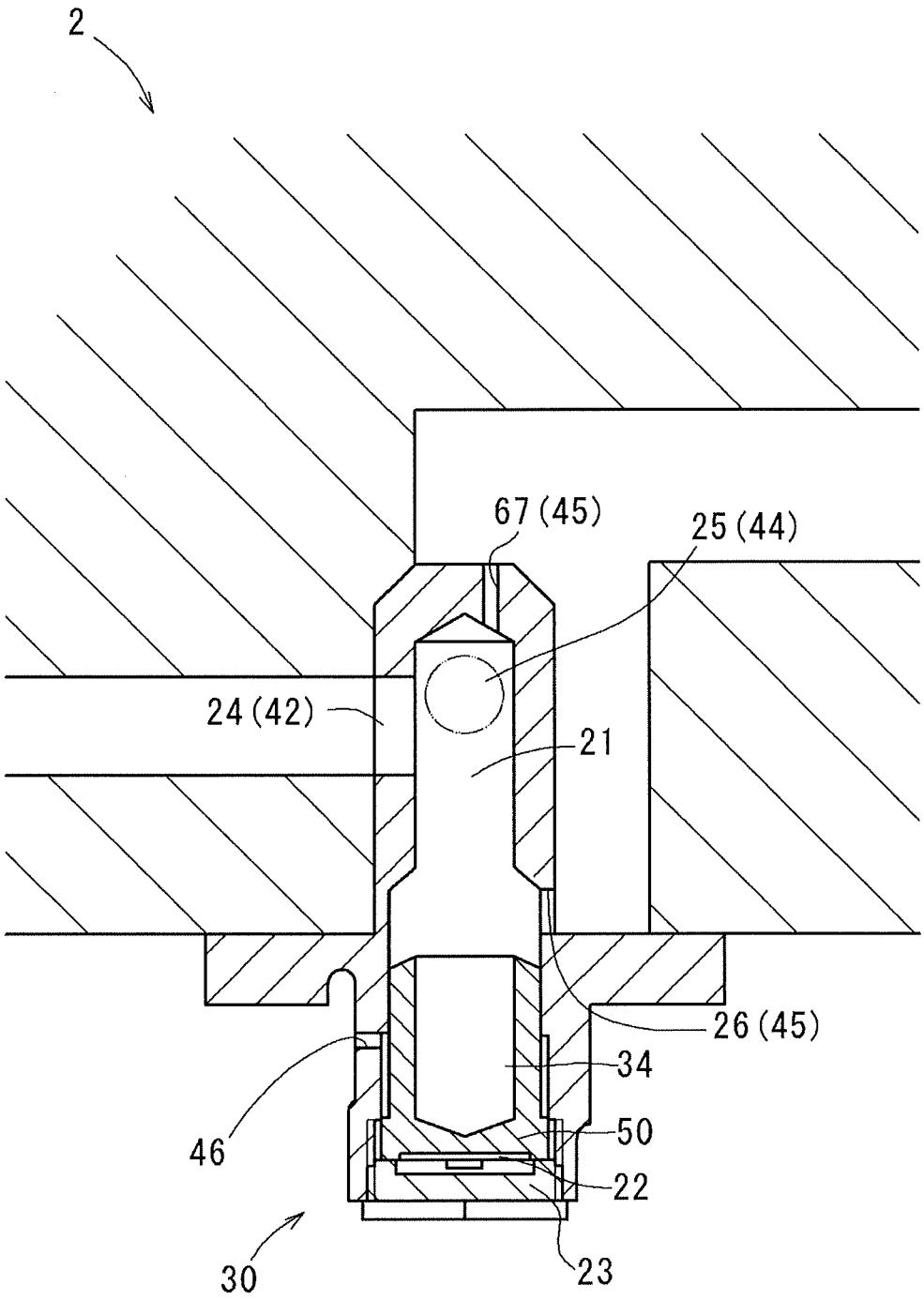
FIG. 10 is a cross-sectional rear view of the oil supply adjusting valve of the oil supply device according to a fourth embodiment when the oil switching valve connecting to the oil supply adjusting valve is not in operation.
Figure 11:
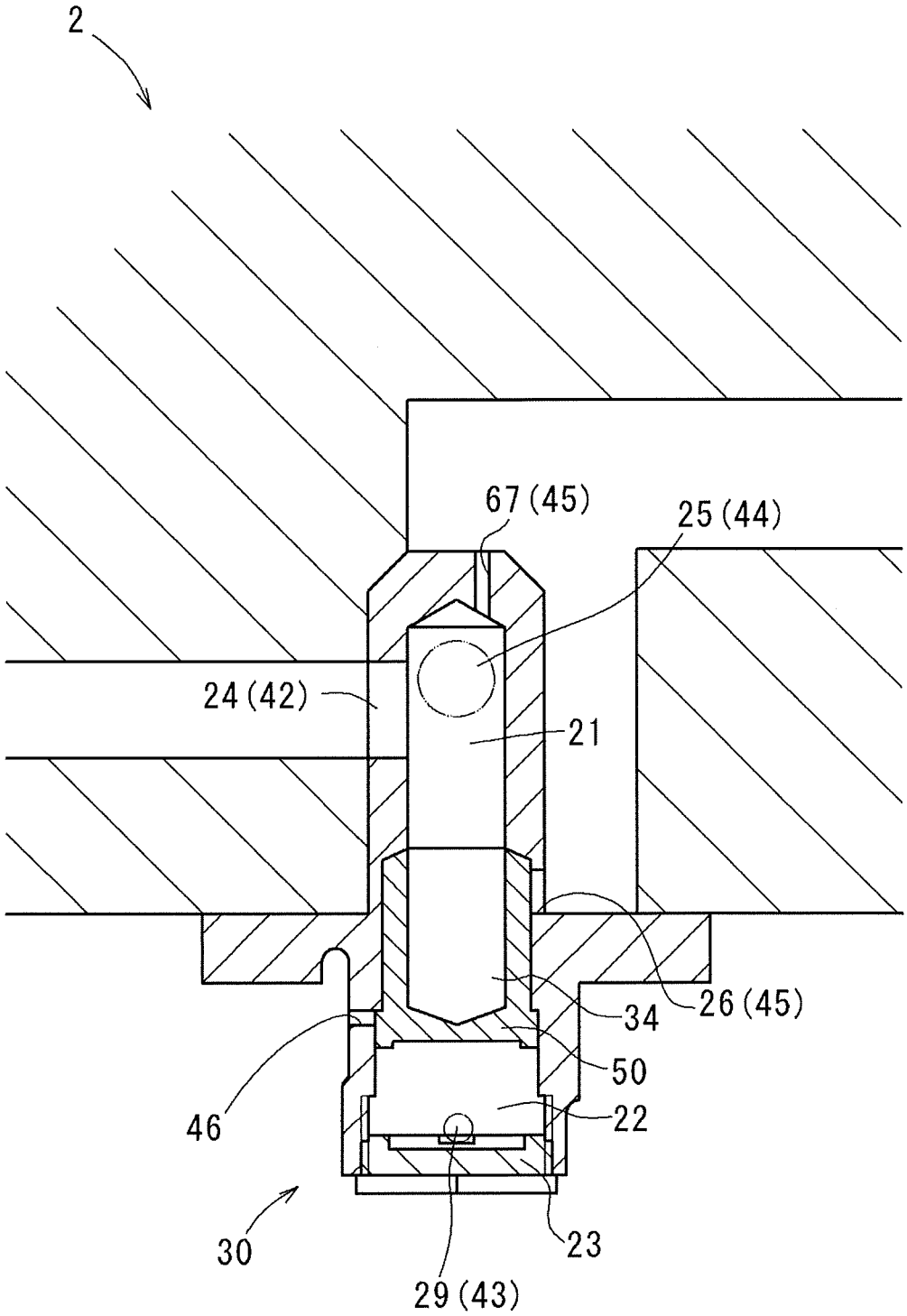
FIG. 11 is a cross-sectional rear view of the oil supply adjusting valve of the oil supply device according to the fourth embodiment when the oil switching valve connecting to the oil supply adjusting valve is in operation.

A fourth embodiment of the oil supply device 1 will be described as follows with reference to FIG. 10 and FIG. 11. The oil supply device 1 according to the fourth embodiment is different from the oil supply device 1 according to the second embodiment in that a third oil supply passage portion 67 is arranged at a different position from the position of the third oil supply passage portion 27 of the second embodiment. Other configurations of the fourth embodiment are the same as those of the second embodiment; therefore explanations of the same configurations will be omitted. In addition, the fourth embodiment is a modified example of the second embodiment. Alternatively, the third oil supply passage portion 67 described in the fourth embodiment may be applied to the oil supply adjusting valve 2 of the first and third embodiments. An oil passage routing chart of the fourth embodiment is the same as that of the first embodiment.

The third oil supply passage portion 67 of the fourth embodiment is in the opposite direction from the second oil passage portion 26 relative to the first oil supply passage portion 25. That is, the second oil supply passage portion 26, the first oil supply passage portion 25, and the third oil supply passage portion 67 are arranged in the stated order as seen from the spool 50 in a longitudinal direction (an axial direction) of the spool 50. The third oil supply passage portion 67 is positioned as described above, thereby being configured as a separated passage from the second oil passage portion 26. Accordingly, an opening of the third oil supply passage 67 may be easily and precisely processed to thereby accurately set a flow rate of the oil flowing through the third oil supply passage 67.

Further, when the third oil supply passage portion 67 is formed separately from the second oil supply passage portion 26, it is not necessary for the second oil supply passage portion 26 and the third oil supply passage portion 67 to include holes having complicated shapes, respectively. In particular, a hole is only drilled in a housing to which the variable valve 30 is attached; thereby, the third oil supply passage portion 67 may be easily processed and accuracy of dimensions of the drilled hole may be easily confirmed after the third oil supply passage portion 67 is processed.

Furthermore, when a condition where the third oil supply passage portion 67 is opened shifts to a condition where the third oil supply passage portion 67 and the second oil supply passage portion 26 are both opened, a hydraulic pressure of the oil discharged from the third oil supply passage portion 67 is prevented from suddenly varying and the oil may be supplied to the engine lubricating system 6 at a desired flow rate.

Specifically, in the case where the second oil supply passage portion 26 and the third oil supply passage portion 27 share the same hole and the area of the opening of the second oil supply passage portion 26 is adjustable by the spring 33 as in the first embodiment, a following situation may be assumed. As described above, since the spool 31 has the hole 31*a*, the hydraulic pressure acts on the area (SA−SB) of the spool 31. Further, the area (SA−SB) is slightly small, compared to the area corresponding to the difference between the areas of the first and second pressure receiving surfaces of the retainer 32. For example, the hydraulic pressure is applied to the small area of the spool 31 to move the spool 31 toward the plug 23 in the opposite direction from the acting direction of the biasing force of the spring 33. In such case, when a condition where the third oil supply passage portion 27 is opened shifts to a condition where the third oil supply passage portion 27 and the second oil supply passage portion 26 are both opened, the spool 31 may vibrate and wiggle due to a variation of the hydraulic pressure. In particular, when the second oil passage portion 26 starts to be opened in accordance with the movement of the spool 31, the hydraulic pressure acting on the spool 31 decreases. Then, the hydraulic pressure acting on the spool 31 becomes smaller than the biasing force of the spring 33; therefore, the opening of the second oil supply passage portion 26 may be closed. Afterward, when the second oil supply passage portion 26 starts to be closed, the hydraulic pressure acting on the spool 31 increases and thereafter acts in the opposite direction of a direction in which a biasing direction of the spring 33 is acting. Accordingly, the second oil supply passage portion 26 starts to be opened. Thus, the variation of the hydraulic pressure acting on the spool 31 causes the spool 31 to vibrate and wiggle and the oil may not be supplied to the engine lubricating system 6 at the desired flow rate.

According to the oil supply device 1 of the fourth embodiment, the third oil supply passage portion 67 is the separated passage (distinct hole) from the second oil supply passage portion 26 and the second oil supply passage portion 26 is located at a distance away from the third oil supply passage portion 67. Consequently, the volume of the oil to be supplied to the engine lubricating system 6 may be prevented from suddenly varying due to the sudden variation of the aforementioned hydraulic pressure acting on the spool 31.

A fifth embodiment of the oil supply device 1 will be explained as follows with reference to FIGS. 12 to 14. The oil supply device 1 according to the fifth embodiment is a modified example of the first embodiment, in which a third oil supply passage portion 77 is arranged in a spool 500 that configures a portion of a variable valve 300. Further, the oil supply device 1 of the fifth embodiment is different from the oil supply device 1 of the first embodiment in that the oil switching valve 7, the first pressure chamber 22, the second oil discharge passage portion 29, the retainer 32, and the second oil discharge passage 43 are not provided (see FIG. 1 for comparison). Other configurations of the fifth embodiment are the same as those of the first embodiment; therefore explanations of the same configurations will be omitted. In addition, the fifth embodiment is a modified example of the first embodiment. Alternatively, the third oil supply passage portion 77 may be applied to the oil supply adjusting valve 2 according to the second and third embodiments.

The spool 500 is configured by first and second portions 500*a* and 500*b*. The first portion 500*a* axially extends (in a longitudinal direction of the spool 500) and faces an inner circumferential surface of the housing to which the variable valve 300 is attached. The second portion 500*b* is continuously formed with the first portion 500*a* while extending in a radial direction of the spool 500. In particular, the spool 500 is formed in an approximately H shape in cross section and the second portion 500*b* serves as a pressure receiving surface of the variable valve 300. The second portion 500*b* receives the hydraulic pressure from the oil flow control portion 21; thereby, the spool 500 is pressed against a biasing force of a spring 330 (biasing member) in a direction to open the second oil supply passage portion 77.

The third oil supply passage portion 77 is formed at the second portion 500*b* so as to be positioned between the first portion 500*a* and the first oil supply passage portion 25. In other words, the oil supply passage portion 77 is formed at the spool 500.

Figure 12:
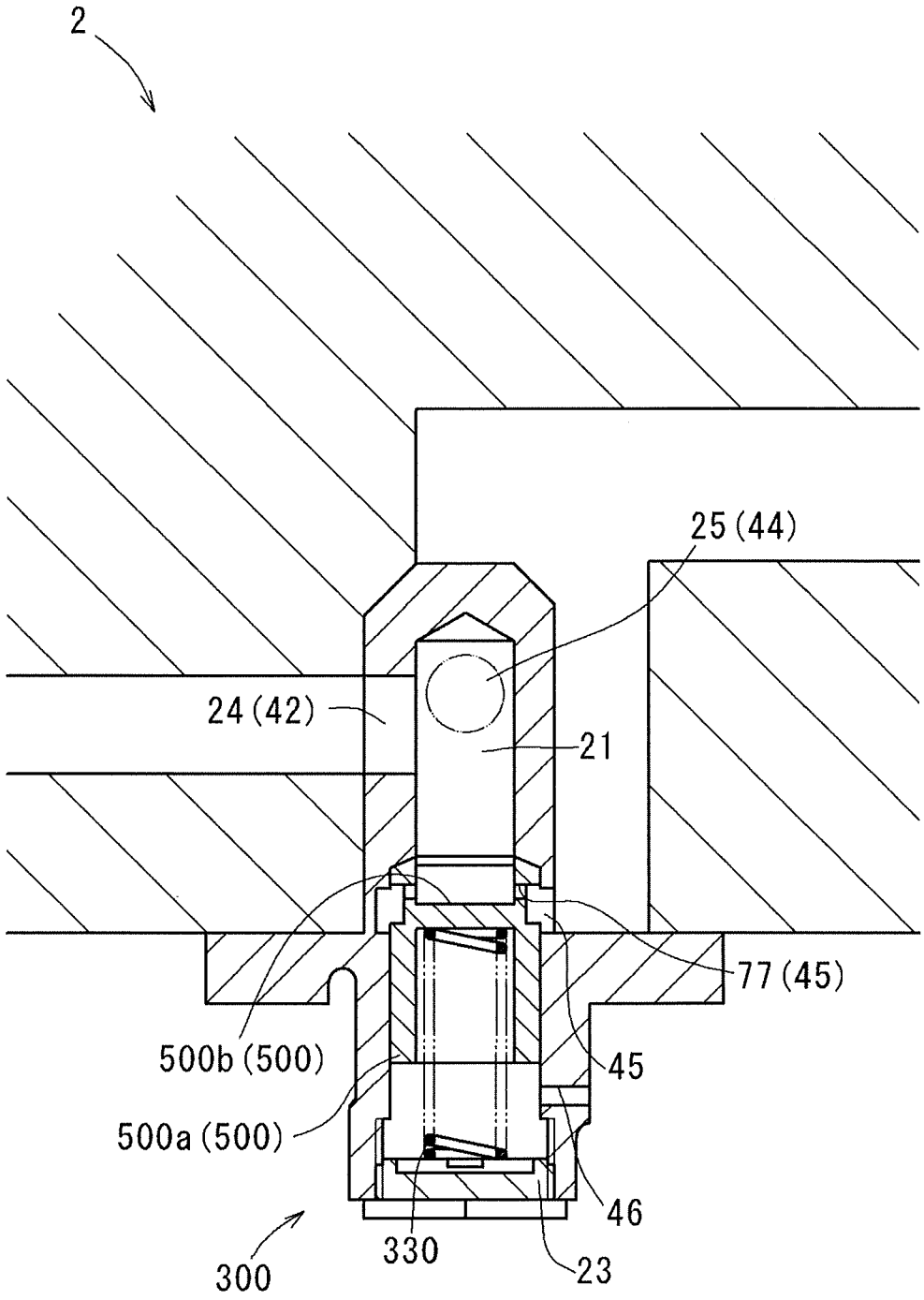
FIG. 12 is a cross-sectional rear view of the oil supply adjusting valve of the oil supply device according to a fifth embodiment disclosed here.

When the spool 500 is biased by the spring 330 as illustrated in FIG. 12, the oil supplied from the first oil discharge passage portion 24 is discharged from the first oil supply passage portion 25. Then, the oil is supplied to the hydraulic actuator 5 at the same time as being discharged from the third oil supply passage portion 77 to be thereafter supplied to the engine lubricating system 6. At this time, an area of an opening of the third oil supply passage portion 77 is small compared to an area of an opening of the first oil supply passage portion 25. Accordingly, the volume of the oil to be supplied to the engine lubricating system 6 is relatively small, compared to the volume of the oil to be supplied to the hydraulic actuator 5.

Figure 13:
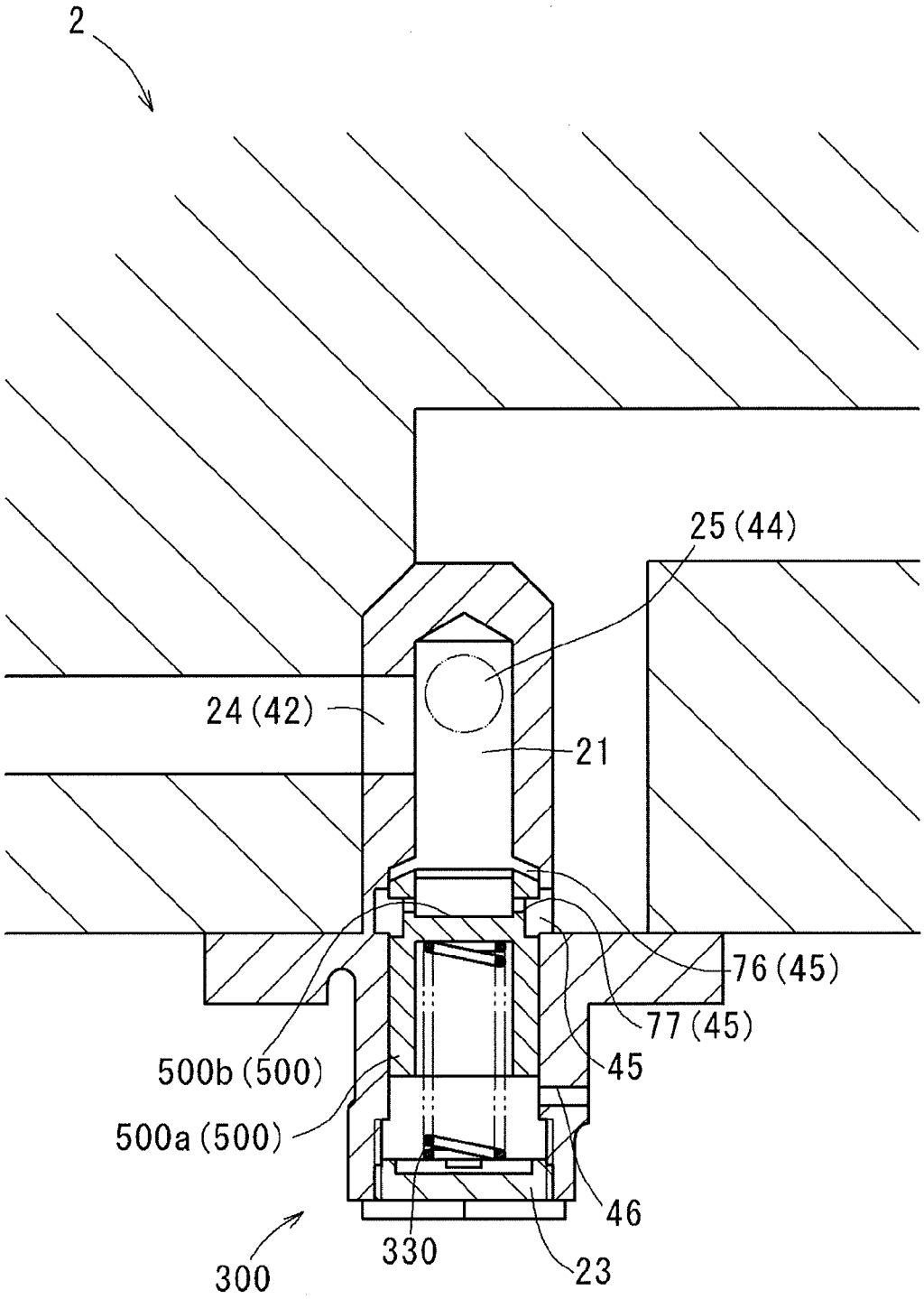
FIG. 13 is a cross-sectional rear view of the oil supply adjusting valve of the oil supply device according to the fifth embodiment disclosed here.

In the case where a hydraulic pressure is applied to the second portion 500*b* of the spool 500 to thereby move the spool 500 toward the plug 23 in the opposite direction from the acting direction of the biasing force of the spring 330 as illustrated in FIG. 13, when the hydraulic pressure acting on the second portion 500*b* is low and a second oil supply passage portion 76 is not opened, the volume of the oil to be supplied to the engine lubricating system 6 is small compared to the volume of the oil to be supplied to the hydraulic actuator 5.

Figure 14:
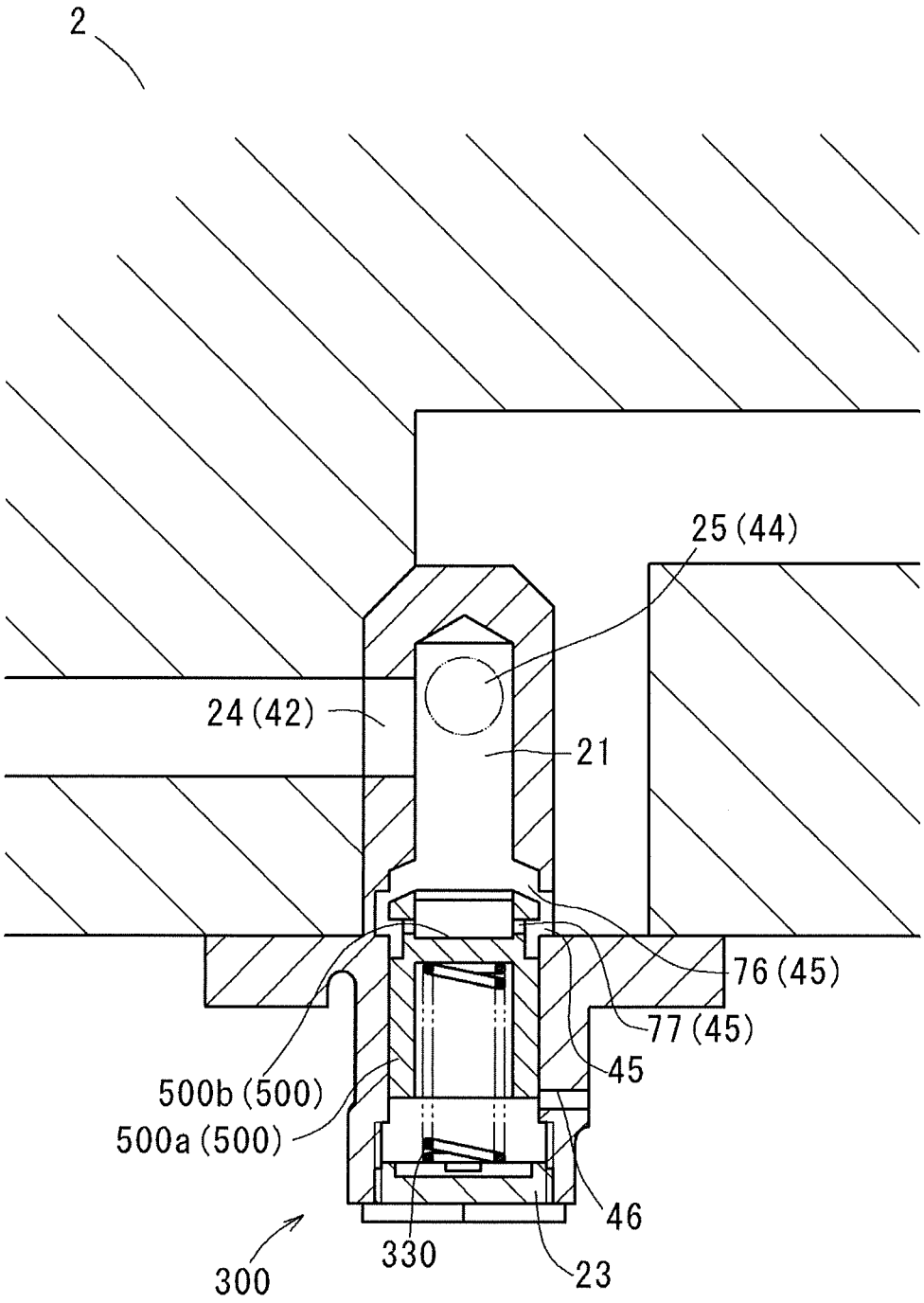
FIG. 14 is a cross-sectional rear view of the oil supply adjusting valve of the oil supply device according to the fifth embodiment disclosed here.

When the hydraulic pressure acting on the second portion 500*b* increases and acts in the opposite direction from the acting direction of the biasing force of the spring 330 as shown in FIG. 14, the spool 500 is moved toward the plug 23 to thereby open the second oil supply passage portion 76. At this time, the oil discharged from the second oil supply passage portion 76 and the third oil supply passage portion 77 is supplied to the engine lubricating system 6. Under this condition, the oil is sufficiently supplied to the engine lubricating system 6 and to inner sliding surfaces of the internal combustion engine, thereby appropriately lubricating the internal combustion engine.

According to the configuration of the oil supply adjusting valve 2 of the fifth embodiment, the third oil supply passage portion 77 separated from the second oil supply passage portion 76 is arranged in the spool 500. In this case, the second oil supply passage portion 76 and the third oil supply passage portion 77 do not need to be formed so as to have holes having complicated shapes. In particular, the hole of the third oil supply passage portion 77 may be easily formed by only drilling a hole in the spool 500. Further, accuracy of dimensions of the drilled hole may be easily confirmed after the third oil supply passage portion 77 is processed.

Further, when a condition where the third oil supply passage portion 77 is opened shifts to a condition where the third oil supply passage portion 77 and the second oil supply passage portion 76 are both opened, a hydraulic pressure of the oil discharged from the third oil supply passage portion 77 is prevented from suddenly varying and the oil is supplied to the engine lubricating system 6 at the desired flow rate.

Furthermore, according to the configuration of the fifth embodiment, the third oil supply passage portion 77 is arranged in the spool 500. Accordingly, the oil supply adjusting valve 2 is only simply processed relative to a housing for the oil supply adjusting valve 2. As a result, the housing may be integrally formed with a cylinder block, a timing chain cover, or the like of the internal combustion engine and therefore is configured at low cost.

As described above, in the oil supply device 1 of the first to fifth embodiments, the oil is consistently distributed by the oil supply adjusting valve 2 from the oil pump 4 to the hydraulic actuator 5 via the first oil supply passage 44 and to the engine lubricating system 6 via second oil supply passage 45. Accordingly, for example, even when foreign matters accumulate in the oil supply adjusting valve 2 and therefore causes the oil to coagulate in the oil supply adjusting valve 2, the engine lubricating system 6 is prevented from being damaged due to a malfunction of the oil supply adjusting valve 2.

Further, according to the aforementioned configuration of the oil supply device 1, the hydraulic pressure from the single oil pump 4 may be utilized to the hydraulic actuator 5 and the engine lubricating system 6 without an additional or supplemental oil pump for the oil pump 4. Accordingly, the number of components of the oil supply device 1 is decreased, therefore reducing the size, cost, and processing hours of the oil supply device 1.

According to the aforementioned first, second, and third embodiments, the oil supply adjusting valve 2 includes the oil flow control portion 21, the variable valve 3, 30 sliding within the oil flow control portion 21 and varying the supply condition of the oil to the hydraulic actuator 5 and the engine lubricating system 6, and the first pressure chamber 22 sliding the variable valve 3, 30 toward the oil flow control portion 21. Further, the oil flow control portion 21 includes the first oil supply passage portion 25 connected to the first oil supply passage 44 and the second oil supply passage portion 26 connected to the second oil supply passage 45.

Accordingly, the hydraulic pressure from the first pressure chamber 22 allows the variable valve 3, 30 to slide within the oil flow control portion 21 and serves as the throttle valve. Consequently, the oil distributed from the oil pump 4 to at least either one of the first oil supply passage 44 and the second oil supply passage 45 may be reduced by the throttle valve, therefore adjusting the hydraulic states of the hydraulic actuator 5 and the engine lubricating system 6. Thus, as long as a power to operate the variable valve 3 is obtained, the configuration of the oil supply device 1 may be realized without a large device such as an electric motor requiring more power.

According to the aforementioned first embodiment, the oil flow control portion 21 includes the third oil supply passage portion 27 consistently distributing the oil relative to the second oil supply passage 45 and flowing the oil to the second oil supply passage 45 at the flow rate that is smaller than the flow rate of the oil flowing from the second oil supply passage portion 26 to the second oil supply passage 45.

Accordingly, in the case where the oil is supplied preferentially to the hydraulic actuator 5 by the variable valve 3, even when the second oil supply passage 45 is closed by the variable valve 3, the engine lubricating system 6 may be maintained at a constant hydraulic pressure by the third oil supply passage portion 27 through which the oil is consistently discharged to the second oil supply passage 45. For example, when the engine lubricating system 6 necessarily secures a minimum hydraulic pressure, the oil may be discharged to the third oil supply passage portion 27 at a flow rate for securing the minimum hydraulic pressure without being preferentially discharged to the engine lubricating system 6.

According to the aforementioned first embodiment, the oil flow control portion 21 is configured so that the second oil supply passage portion 26 is provided closer to the variable valve 3 than the first oil supply passage portion 25. The oil flow control portion 21 includes the connecting portion 28 connecting to the third oil supply passage portion 27 and configured to have the cross-sectional area of the flow passage decreasing from the second oil supply passage portion 26 to the third oil supply passage portion 27.

Accordingly, the oil flows into the first pressure chamber 22 to slide the variable valve 3 toward the oil flow control portion 21 and thereby is easily supplied preferentially to the hydraulic actuator 5. Further, when the supply condition of the oil to the engine lubricating system 6 shifts from a maximum pressure level to a minimum pressure level, the hydraulic state of the engine lubricating system 6 is prevented from suddenly varying by the connecting portion 28 having the cross-sectional area of the flow passage decreasing from the second oil supply passage portion 26 to the third oil supply passage portion 27. In addition, an occurrence of a water hammer phenomenon caused by a sudden change in the flow of the oil is prevented and the oil supply device 1 is prevented from being damaged by the water hammer phenomenon.

According to the aforementioned first and third embodiments, the variable valve 3 includes the spool 31 having the hole 31*a*, the spring 33 biasing the spool 31 toward the oil flow control portion 21, and the retainer 32 arranged in a condition where the spring 33 is attached between the spool 31 and the retainer 32. Further, the oil flows through the hole 31*a* between the spool 31 and the retainer 32.

Accordingly, a hydraulic pressure acts on the area of the spool 31, corresponding to the difference between the first pressure receiving surface positioned to face the oil flow control portion 21 and the second pressure receiving surface positioned to face the spring 33. Further, for example, the area of the spool 31 is small, compared to the spool 31 that does not have the hole 31*a*. As a result, even when the biasing force of the spring 33 is small, the supply condition of the oil to the hydraulic actuator 5 and the engine lubricating system 6 may be varied. Further, the length of the variable valve 3 may be changed depending on the hydraulic pressure states of the hydraulic actuator 5 and the engine lubricating system 6 and the oil may be consistently supplied to the hydraulic actuator 5 and the engine lubricating system 6 at appropriate hydraulic pressure and flow rate. Thus, the spring 33 biasing the spool 31 toward the oil flow control portion 21 is downsized and the oil supply adjusting valve 2 and the oil supply device 1 are downsized.

According to the aforementioned first embodiment, the difference between the areas SA and SB of the first and second pressure receiving surfaces of the spool 31 is smaller than the difference between the areas of the first and second pressure receiving surfaces of the retainer 32. The first pressure receiving surface of the spool 31 is positioned to face the oil flow control portion 21 while the second pressure receiving surface of the spool 31 is positioned to face the spring 33. The first pressure receiving surface of the retainer 32 is positioned to face the first pressure chamber 22 while the second pressure receiving surface of the retainer 32 is positioned to face the spring 33.

Accordingly, when a condition where the oil is not supplied to the first pressure chamber 22 shifts to a condition where the oil is supplied to the first pressure chamber 22, the spool 31 may be integrally slid with the retainer 32 by the hydraulic pressure acting from the first pressure chamber 22 to the spool 31 and the retainer 32. Further, when the rotating speed of the oil pump 4 increases to thereby increase the hydraulic pressure applied from the oil flow control portion 21 to the spool 31 under the aforementioned condition where the oil is supplied to the first pressure chamber 22, only the spool 31 is slid within the oil flow control portion 21 while the retainer 32 is not slid within the oil flow control portion 21. Consequently, the length of the variable valve 3 may be varied depending on the hydraulic states of the hydraulic actuator 5 and the engine lubricating system 6 and the oil may be supplied to the hydraulic actuator 5 and the engine lubricating system 6 at the appropriate hydraulic pressure and oil flow.

According to the aforementioned first to fifth embodiments, when the internal combustion engine is not in operation, the variable valve 3, 30, 300 is located in a position in which the supply of the oil from the oil pump 4 to the engine lubricating system 6 is not limited.

Accordingly, even when the variable valve 3, 30, 300 may not smoothly operate due to an increase of viscosity of the oil when the oil is cooled, a necessarily hydraulic pressure may be applied to the hydraulic actuator 5. Further, the configuration above is effective when foreign matters are mixed into the oil to therefore cause the variable valve 3, 30, 300 not to operate.

According to the aforementioned third embodiment, when the internal combustion engine is not in operation, the variable valve 3 is located by gravity in the position in which the supply of the oil from the oil pump 4 to the engine lubricating system 6 is not limited.

Accordingly, the oil supply device 1 may be simply configured without requiring a regulating member regulating the variable valve 3; therefore a case where the regulating member may not regulate the variable valve 3 due to a malfunction and the like may be of no concern.

According to the aforementioned fourth embodiment, the third oil supply passage portion 67 is in the opposite direction from the second oil passage portion 26 relative to the first oil supply passage portion 25.

Accordingly, the third oil supply passage portion 67 may be formed into a single oil passage independently from the second oil supply passage portion 26; therefore, an area of the opening of the third oil supply passage portion 67 may be precisely designed. As a result, the flow rate of the oil flowing through the third oil supply passage portion 67 may be accurately set.

According to the aforementioned fourth embodiment, the third oil supply passage portion 67 is formed away from the second oil supply passage portion 26.

Accordingly, in particular, when the condition where the third oil supply passage portion 67 is opened shifts to the condition where the third oil supply passage portion 67 and the second oil supply passage portion 26 are both opened, the hydraulic pressure of the oil discharged from the third oil supply passage portion 67 is prevented from suddenly varying and the oil may be supplied to the engine lubricating system 6 at the desired flow rate.

According to the aforementioned fifth embodiment, the third oil supply passage portion 77 is provided at the variable valve 300.

Accordingly, it is not necessary that the third oil supply passage portion 77 is formed in the housing to which the variable valve 300 is attached. For example, in the case where the housing to which the variable valve 300 is attached is integrally formed with the cylinder block or the timing chain cover for the internal combustion engine, when the third oil supply passage portion 77 is formed in the housing that is a larger member in size than the variable valve 300, the third oil supply passage portion 77 is required to be processed more accurately for the larger member, therefore further increasing the difficulty of processing of the third oil supply passage portion 77. However, as in the fifth embodiment, when the third oil supply passage portion 77 is formed in the variable valve 300 that is small in size, only a simple hole drilling process is required and precision of the drilled hole is easily confirmed after the hole drilling process.

According to the aforementioned fifth embodiment, the third oil supply passage portion 77 is formed between the first oil supply passage 25 and the pressure receiving surface 500*b* of the variable valve 300, which is pressed in a direction to open the second oil supply passage portion 76.

When the case where the third oil supply passage portion 77 is opened shifts to the case where the third oil supply passage portion 77 and the second oil supply passage portion 76 are both opened, the hydraulic pressure of the oil discharged from the third oil supply passage portion 77 is prevented from suddenly varying and the oil may be supplied to the engine lubricating system 6 at the desired flow rate.

According to the aforementioned first to fifth embodiments, the oil supply adjusting valve 2 is provided at the second oil supply passage 45.

Accordingly, the single oil supply adjusting valve 2 having a simple configuration may adjust the hydraulic states of the hydraulic actuator 5 and the engine lubricating system 6.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An oil supply device for a vehicle, comprising:

an oil pump driven by a rotation of an internal combustion engine;

a hydraulic actuator to which oil is supplied from the oil pump;

an engine lubricating system to which the oil is supplied from the oil pump;

an oil supply adjusting valve adjusting a supply condition of the oil from the oil pump to the hydraulic actuator and the engine lubricating system;

a first oil supply passage supplying the oil from the oil pump to the hydraulic actuator; and a second oil supply passage supplying the oil from the oil pump to the engine lubricating system, wherein the oil supply adjusting valve consistently distributes the oil to the first oil supply passage and the second oil supply passage.

2. The oil supply device according to claim 1, wherein the oil supply adjusting valve includes an oil flow control portion, a variable valve sliding within the oil flow control portion and varying the supply condition of the oil to the hydraulic actuator and the engine lubricating system, and a pressure portion sliding the variable valve toward the oil flow control portion, the oil flow control portion including a first oil supply passage portion connected to the first oil supply passage and a second oil supply passage portion connected to the second oil supply passage.

3. The oil supply device according to claim 2, wherein the oil flow control portion includes a third oil supply passage portion consistently distributing the oil relative to the second oil supply passage and flowing the oil to the second oil supply passage at a flow rate that is smaller than a flow rate of the oil flowing from the second oil supply passage portion to the second oil supply passage.

4. The oil supply device according to claim 2, wherein the oil flow control portion is configured so that the second oil supply passage portion is provided closer to the variable valve than the first oil supply passage portion, the oil flow control portion including a connecting portion connecting to the third oil supply passage portion and configured to have a cross-sectional area of a flow passage decreasing from the second oil supply passage portion to the third oil supply passage portion.

5. The oil supply device according to claim 2, wherein the variable valve includes a spool having a hole, a biasing member biasing the spool toward the oil flow control portion, and a retainer arranged in a condition where the biasing member is attached between the spool and the retainer, and the oil flows through the hole between the spool and the retainer.

6. The oil supply device according to claim 3, wherein the variable valve includes a spool having a hole, a biasing member biasing the spool toward the oil flow control portion, and a retainer arranged in a condition where the biasing member is attached between the spool and the retainer, and the oil flows through the hole between the spool and the retainer.

7. The oil supply device according to claim 4, wherein the variable valve includes a spool having a hole, a biasing member biasing the spool toward the oil flow control portion, and a retainer arranged in a condition where the biasing member is attached between the spool and the retainer, and the oil flows through the hole between the spool and the retainer.

8. The oil supply device according to claim 5, wherein a difference between areas of first and second pressure receiving surfaces of the spool is smaller than a difference between areas of first and second pressure receiving surfaces of the retainer, the first pressure receiving surface of the spool being positioned to face the oil flow control portion, the second pressure receiving surface of the spool being positioned to face the biasing member, the first pressure receiving surface of the retainer being positioned to face the pressure portion, the second pressure receiving surface of the retainer being positioned to face the biasing member.

9. The oil supply device according to claim 2, wherein when the internal combustion engine is not in operation, the variable valve is located in a position in which the supply of the oil from the oil pump to the engine lubricating system is not limited.

10. The oil supply device according to claim 3, wherein when the internal combustion engine is not in operation, the variable valve is located in a position in which the supply of the oil from the oil pump to the engine lubricating system is not limited.

11. The oil supply device according to claim 4, wherein when the internal combustion engine is not in operation, the variable valve is located in a position in which the supply of the oil from the oil pump to the engine lubricating system is not limited.

12. The oil supply device according to claim 2, wherein when the internal combustion engine is not in operation, the variable valve is located by gravity in a position in which the supply of the oil from the oil pump to the engine lubricating system is not limited.

13. The oil supply device according to claim 3, wherein when the internal combustion engine is not in operation, the variable valve is located by gravity in a position in which the supply of the oil from the oil pump to the engine lubricating system is not limited.

14. The oil supply device according to claim 4, wherein when the internal combustion engine is not in operation, the variable valve is located by gravity in a position in which the supply of the oil from the oil pump to the engine lubricating system is not limited.

15. The oil supply device according to claim 3, wherein the third oil supply passage portion is in an opposite direction from the second oil passage portion relative to the first oil supply passage portion.

16. The oil supply device according to claim 15, wherein the third oil supply passage portion is formed away from the second oil supply passage portion.

17. The oil supply device according to claim 3, wherein the third oil supply passage portion is provided at the variable valve.

18. The oil supply device according to claim 17, wherein the third oil supply passage portion is formed between the first oil supply passage and a pressure receiving surface of the variable valve, which is pressed in a direction to open the second oil supply passage portion.

19. The oil supply device according to claim 1, wherein the oil supply adjusting valve is provided at the second oil supply passage.

20. An oil supply device for a vehicle, comprising:

a hydraulic actuator provided at an internal combustion engine and being operated by a hydraulic pressure;

an engine lubricating system lubricating the internal combustion engine;

an oil pump supplying oil to the hydraulic actuator and the engine lubricating system; and an oil supply adjusting valve arranged between the hydraulic actuator and the oil pump and between the engine lubricating system and the oil pump and distributing the oil, which is discharged from the oil pump, to the hydraulic actuator and the engine lubricating system;

wherein the oil supply adjusting valve consistently distributes the oil to the hydraulic actuator and the engine lubricating system.

* * * * *